US007324770B2

(12) United States Patent
Cho

(10) Patent No.: US 7,324,770 B2
(45) Date of Patent: Jan. 29, 2008

(54) PRINTING APPARATUS, FUSING APPARATUS, AND METHOD OF CONTROLLING FUSING TEMPERATURE OF PRINTING APPARATUS

(75) Inventor: Durk-hyun Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 204 days.

(21) Appl. No.: 11/147,217

(22) Filed: Jun. 8, 2005

(65) Prior Publication Data

US 2005/0276625 A1 Dec. 15, 2005

(30) Foreign Application Priority Data

Jun. 9, 2004 (KR) ..... 10-2004-0042209

(51) Int. Cl.
*G03G 15/20* (2006.01)

(52) U.S. Cl. ..... 399/67; 399/69; 399/70; 399/320

(58) Field of Classification Search ..... 399/122, 399/70, 320, 335
See application file for complete search history.

(56) References Cited

U.S. PATENT DOCUMENTS

| | | | | |
|---|---|---|---|---|
| 5,329,343 | A | 7/1994 | Saito | |
| 5,671,462 | A * | 9/1997 | Toyohara et al. | 399/33 |
| 5,682,576 | A | 10/1997 | Sakai et al. | |
| 5,708,920 | A | 1/1998 | Ohnishi et al. | 399/69 |
| 5,875,372 | A * | 2/1999 | Sato et al. | 399/67 |
| 5,890,043 | A * | 3/1999 | Uehara | 399/307 |
| 5,899,598 | A | 5/1999 | Yamauchi | 399/67 |
| 2002/0136562 | A1 | 9/2002 | Hiroki et al. | 399/69 |
| 2003/0091359 | A1* | 5/2003 | Cho et al. | 399/69 |
| 2004/0086292 | A1 | 5/2004 | Kamimura | |
| 2004/0086294 | A1* | 5/2004 | Kataoka | 399/69 |

FOREIGN PATENT DOCUMENTS

| | | |
|---|---|---|
| JP | 09-212035 | 8/1997 |
| JP | 10-39671 | 2/1998 |
| JP | 2001-083828 | 3/2001 |
| JP | 2001-265157 | 9/2001 |
| JP | 2002-169414 | 6/2002 |
| JP | 2003-302874 | 10/2003 |
| JP | 2003-307969 | 10/2003 |
| KR | 10-2003-0060391 | 7/2003 |

* cited by examiner

*Primary Examiner*—David M. Gray
*Assistant Examiner*—David A Blackshire
(74) *Attorney, Agent, or Firm*—Roylance, Abrams, Berdo & Goodman, LLP

(57) ABSTRACT

A printing apparatus including a heat roller, a pressure roller, a fusing apparatus, and a method of controlling a fusing temperature of the printing apparatus. The printing apparatus includes a heat roller, a first temperature sensor which senses a temperature of the heat roller, a first heat source which is installed inside the heat roller, a second heat source which is installed inside the heat roller and has a lower heat capacity than the first heat source, a pressure roller, and a control unit which controls the first and second heat source based on the temperature sensed by the first temperature sensor. The printing apparatus further includes a third heat source which is installed inside the pressure roller, wherein the control unit controls the first, second and third heat sources to reduce a warm-up time, power consumption, flicker and overshoot, while providing a stable fusing operation.

27 Claims, 6 Drawing Sheets

PRINTING APPARATUS, FUSING APPARATUS, AND METHOD OF CONTROLLING FUSING TEMPERATURE OF PRINTING APPARATUS

CROSS-REFERENCE TO RELATED APPLICATIONS

This application claims the benefit under 35 U.S.C. 119(a) of Korean Patent Application No. 10-2004-0042209, filed in the Korean Intellectual Property Office on Jun. 9, 2004, the entire disclosure of which is hereby incorporated by reference.

BACKGROUND OF THE INVENTION

1. Field of the Invention

The present invention relates to a printing apparatus, a fusing apparatus, and a method of controlling a fusing temperature of the printing apparatus. More particularly, the present invention relates to a printing apparatus comprising a heat roller including a first heat source and a second heat source with a lower heat capacity than the first heat source to fuse a toner image formed on a printing medium, a fusing apparatus, and a method of controlling a fusing temperature of the printing apparatus.

2. Description of the Related Art

In general, electrophotographic printing apparatuses, such as printers or digital multi-function machines, include fusing apparatuses that fuse a toner image formed on a printing medium. These digital multi-function machines are designed to offer at least one of the features of a printer, scanner, copier, and facsimile.

A conventional fusing apparatus employing a halogen lamp is disclosed in U.S. Patent Publication No. 2002-136562, the entire disclosure of which is hereby incorporated by reference.

FIG. 1 is a schematic diagram of a conventional fusing apparatus including a heat roller and a pressure roller. Referring to FIG. 1, a fusing apparatus 10 includes a cylindrical heat roller 11 and a pressure roller 13 disposed under the heat roller 11 to face the heat roller 11. A printing medium 14 is placed between the heat roller 11 and the pressure roller 13.

A halogen lamp 12 is installed as a heat source in the center of the heat roller 11. A coating layer 11*a* made of Teflon is formed on a surface of the heat roller 11. The halogen lamp 12 inside the heat roller 11 generates heat, and the heat roller 11 is heated by radiant heat transferred from the halogen lamp.

The pressure roller 13 is elastically supported by a spring unit 13*a* such that the pressure roller 13 presses the printing medium 14 passing between the heat roller 11 and the pressure roller 14 toward the heat roller 11 under a predetermined pressure. While passing between the heat roller 11 and the pressure roller 13, a powder toner image 14*a* formed on the printing medium 14 is pressed and heated by a predetermined pressure and heat. That is, the toner image 14*a* is fused and fixed to the printing medium 14 due to the predetermined heat and pressure generated by the heat roller 11 and the pressure roller 13.

The conventional fusing apparatus having a single heat source inside the heat roller, however, requires a considerably long warm-up time until the heat roller reaches a fusing temperature after the apparatus is turned on to perform a printing operation. Further, if the warm-up time is reduced incorrectly, a high temperature overshoot occurs. In addition, when a single halogen lamp is used, it is difficult for a high speed printer, such as those operating at about 50 ppm, to ensure a stable fusing operation during continuous printing, and power consumption is high.

Accordingly, a need exists for a system and method to efficiently perform a heat roller warm-up having a reduced warm-up time and minimal temperature overshoot.

SUMMARY OF THE INVENTION

The present invention provides a printing apparatus comprising a heat roller including a first heat source and a second heat source with a lower heat capacity than the first heat source to fuse a toner image formed on a printing medium.

The present invention also provides a fusing apparatus comprising a heat roller including a first heat source and a second heat source with a lower heat capacity than the first heat source to fuse a toner image formed on a printing medium.

The present invention further provides a method of controlling a fusing temperature of a printing apparatus comprising a heat roller including a first heat source and a second heat source with a lower heat capacity than the first heat source to fuse a toner image formed on a printing medium.

According to an aspect of the present invention, a printing apparatus is provided comprising a heat roller which transfers heat to a toner image formed on a printing medium, a first temperature sensor which senses a temperature of the heat roller, a first heat source which is installed inside the heat roller, a second heat source which is installed inside the heat roller and has a lower heat capacity than the first heat source, a pressure roller which faces the heat roller and presses the printing medium toward the heat roller, and a control unit which controls the first heat source and the second heat source based on the temperature sensed by the first temperature sensor.

The printing apparatus may further comprise a third heat source, which is installed inside the pressure roller, wherein the control unit further controls the third heat source.

According to another aspect of the present invention, a fusing apparatus is provided comprising a heat roller which transfers heat to a toner image formed on a printing medium, a first heat source which is installed inside the heat roller, a second heat source which is installed inside the heat roller and has a lower heat capacity than the first heat source, and a pressure roller which faces the heat roller and presses the printing medium toward the heat roller.

The fusing apparatus may further comprise a third heat source, which is installed inside the pressure roller.

According to still another aspect of the present invention, a method of controlling a fusing temperature in a printing apparatus is provided, wherein the printing apparatus includes a heat roller for transferring heat to a toner image formed on a printing medium and a pressure roller facing the heat roller for pressing the printing medium toward the heat roller to fuse the toner image to the printing medium. The method comprises the steps of sensing a temperature of the heat roller, determining whether the temperature of the heat roller is a first predetermined temperature which is higher than a normal temperature, or a second predetermined temperature which is higher than the first predetermined temperature and is high enough to fuse and fix toner, and controlling a first heat source which is installed inside the heat roller, and a second heat source which is installed inside the heat roller and has a lower heat capacity than the first heat source, according to the determined temperature of the heat roller.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which a number of exemplary embodiments of the present invention are shown. Terms of elements used hereinafter have been defined in consideration of the functions of the elements in the invention, but can be redefined according to a user's or an operator's needs or customs. Thus, the definition of the terms should be made in light of the context of this specification as a whole.

Figure 1:
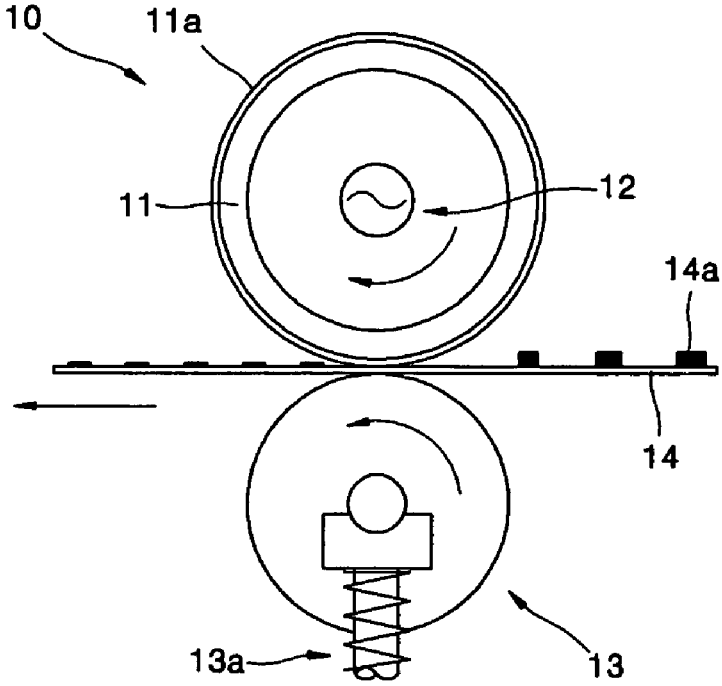
FIG. 1 (PRIOR ART)
FIG. 1 is a schematic diagram of a conventional fusing apparatus including a heat roller and a pressure roller.
Figure 2:
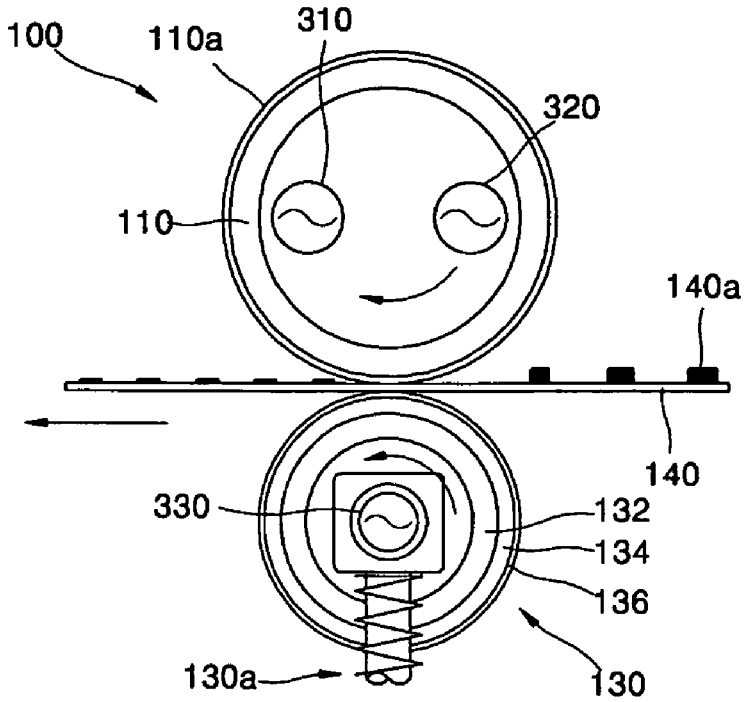
FIG. 2 is a schematic diagram of a fusing apparatus including a heat roller and a pressure roller according to an exemplary embodiment of the present invention.

FIG. 2 is a schematic diagram of a fusing apparatus including a heat roller and a pressure roller according to an exemplary embodiment of the present invention. Referring to FIG. 2, a fusing apparatus 100 includes a cylindrical heat roller 110 and a pressure roller 130, which is disposed under the heat roller 110 to face the heat roller 110, with a printing medium 140 therebetween.

A first heat source 310 and a second heat source 320 are installed inside the heat roller 110. It is preferable that the first heat source 310 and the second heat source 320 comprise halogen lamps. The heat roller 110 is generally made of aluminium. A coating layer 110*a* made of Teflon is formed on a surface of the heat roller 110. The halogen lamps 310 and 320 inside the heat roller 110 generate heat, and the heat roller 110 is heated by radiant heat transferred from the halogen lamps 310 and 320.

A third heat source 330 is installed inside the pressure roller 130. It is preferable that the third heat source 330 also comprise a halogen lamp. The pressure roller 130 includes an internal roller 132, which is generally made of aluminium, and an elastic layer 134, which is made of rubber and is formed on an outer surface of the internal roller 132. A coating layer 136 made of Teflon is formed on an outer surface of the elastic layer 134. The pressure roller 130 is elastically supported by a spring unit 130*a* such that the pressure roller 130 presses a printing medium 140 passing between the heat roller 110 and the pressure roller 130 toward the heat roller 110 under a predetermined pressure.

While passing between the heat roller 110 and the pressure roller 130, a powder toner image 140*a* formed on the printing medium 140 is pressed and heated by predetermined pressure and heat. That is, the toner image 140*a* is fused and fixed to the printing medium 140 due to the predetermined heat and pressure generated by the heat roller 110 and the pressure roller 130.

As described above, in the fusing apparatus according to an embodiment of the present invention, the heat roller 110 includes two heat sources, that is, the first heat source 310 and the second heat source 320, and the pressure roller 130 includes one heat source, that is, the third heat source 330. The control and function of the first through third heat sources will be explained in greater detail below.

Figure 3:
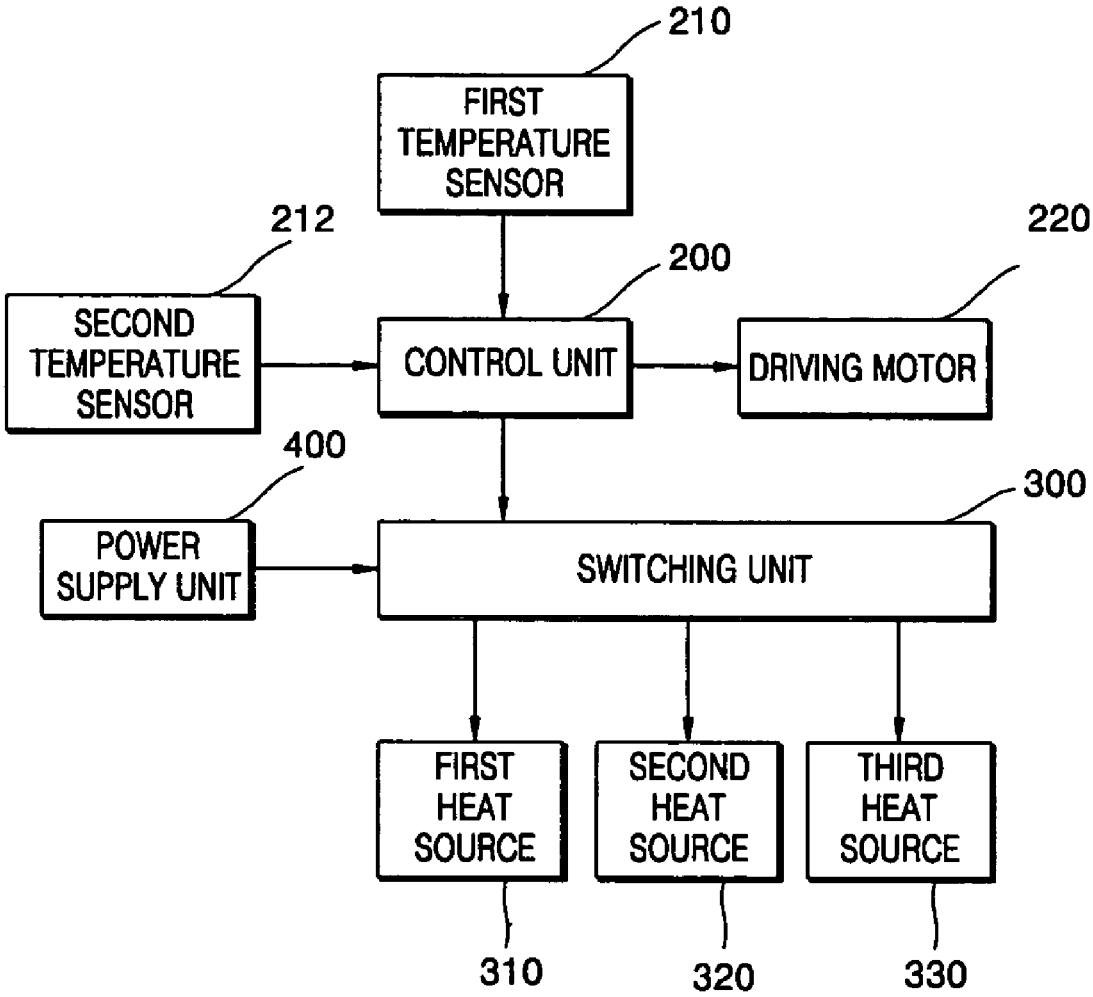
FIG. 3 is a block diagram of an apparatus for controlling a fusing temperature according to an exemplary embodiment of the present invention.

FIG. 3 is a block diagram of an apparatus for controlling a fusing temperature according to an exemplary embodiment of the present invention. The fusing temperature control apparatus in the printing apparatus of FIG. 3 includes a control unit 200, a first temperature sensor 210, a second temperature sensor 212, a driving motor 220, a switching unit 300, a first heat source 310, a second heat source 320, a third heat source 330, and a power supply unit 400.

The first temperature sensor 210 senses a surface temperature of a heat roller, such as the heat roller 110 of FIG. 2, and the second temperature sensor 212 senses a surface temperature of a pressure roller, such as the pressure roller 130 of FIG. 2. The control unit 200 compares the surface temperatures received from the first and second temperature sensors 210 and 212 with a predetermined temperature. The control unit 200 can control the third heat source 330 based on the temperature sensed by the second temperature sensor 212. The driving motor 220 drives the heat roller to rotate according to the control of the control unit 200. The switching unit 300 switches power to the first heat source 310, the second heat source 320, and the third heat source 330, on or off according to the control of the control unit 200. The first heat source 310 and the second heat source 320 are installed inside the heat roller, and the third heat source 330 is installed inside the pressure roller. It is preferable that the second heat source 320 has a lower heat capacity than the first heat source 310.

When the printing apparatus is turned on, the printing apparatus enters a warm-up mode. In the warm-up mode, the control unit 200 determines whether the surface temperature of the heat roller sensed by the first temperature sensor 210 is lower than a first predetermined temperature, is between the first predetermined temperature and a second predetermined temperature, or is higher than the second predetermined temperature. The first predetermined temperature is higher than a normal temperature, and the second predetermined temperature is higher than the first predetermined temperature and is high enough to fuse and fix toner. In an exemplary embodiment of the present invention, it is preferable that the first predetermined temperature be about 160° C., and the second predetermined temperature be about 200° C.

When the surface temperature of the heat roller is lower than the first predetermined temperature, the switching unit 300 turns on the first heat source 310, turns off the second heat source 320, and turns on the third heat source 330, and the control unit 200 controls the driving motor 220 to stop.

When the surface temperature ranges between the first predetermined temperature and the second predetermined temperature, the switching unit 300 repeatedly turns on the first heat source 310 for a first predetermined period of time and then turns off the first heat source 310 for a second predetermined period of time, turns off the second heat source 320, and turns on the third heat source 330, and the control unit 200 controls the driving motor 220 to rotate. In an exemplary embodiment of the present invention, it is preferable that the first predetermined period of time be about 1 second, and the second predetermined period of time be about 2 seconds.

Specifically, the control unit 200 controls the first heat source 310 using a first signal with a high duty ratio to turn on the first heat source 310 when the temperature ranges from the normal temperature to the first predetermined temperature, and controls the first heat source 310 using a second signal with a duty ratio lower than that of the first signal to turn on the first heat source 310 when the temperature ranges from the first predetermined temperature to the second predetermined temperature. In an exemplary embodiment of the present invention, it is preferable that the duty ratio of the first signal be about 100%, and the duty ratio of the second signal be about 33%.

When the surface temperature is higher than the second predetermined temperature, the warm-up mode changes to a stand-by mode or a print mode. If the printing apparatus receives a print command during the warm-up mode, the warm-up mode changes to the print mode to perform a printing operation. If the printing apparatus does not receive any print commands during the warm-up mode, the warm-up mode changes to the stand-by mode.

In the stand-by mode or the print mode, the control unit 200 determines whether the surface temperature of the heat roller is lower or higher than the second predetermined temperature.

If the surface temperature is lower than the second predetermined temperature, the switching unit 300 turns on the first heat source 310 and the third heat source 330 during a third predetermined period of time, and turns off the second heat source 320. Alternatively, if the surface temperature is lower than the second predetermined temperature in the print mode or the stand-by mode, the switching unit 330 turns on the first heat source 310 and the third heat source 330.

If the surface temperature is higher than the second predetermined temperature, the switching unit 300 turns off the first heat source 310 and the third heat source 330, and repeatedly turns on the second heat source 320 for a fourth predetermined period of time, and turns off the second heat source 320 for a fifth predetermined period of time.

In an exemplary embodiment of the present invention, it is preferable that the third through fifth predetermined periods of time be about 2 seconds.

Specifically, the control unit 200 controls the second heat source 320 using a third signal with a duty ratio of about 50% to turn on the second heat source 320.

In an exemplary embodiment of the present invention, it is preferable that when both the first heat source 310 and the third heat source 330 are switched on, the third heat source 330 be switched on at a predetermined interval, such as a predetermined interval of about 500 milliseconds, after the first heat source 310 is switched on. Flicker can then be reduced due to the interval.

The first through third heat sources may be comprised of halogen lamps. In an exemplary embodiment of the present invention, it is preferable that the first heat source 310 be comprised of a halogen lamp with a capacity of 900 watts, the second heat source 320 be comprised of a halogen lamp with a capacity of 300 watts, and the third heat source 330 be comprised of a halogen lamp with a capacity of 300 watts.

Figure 4:
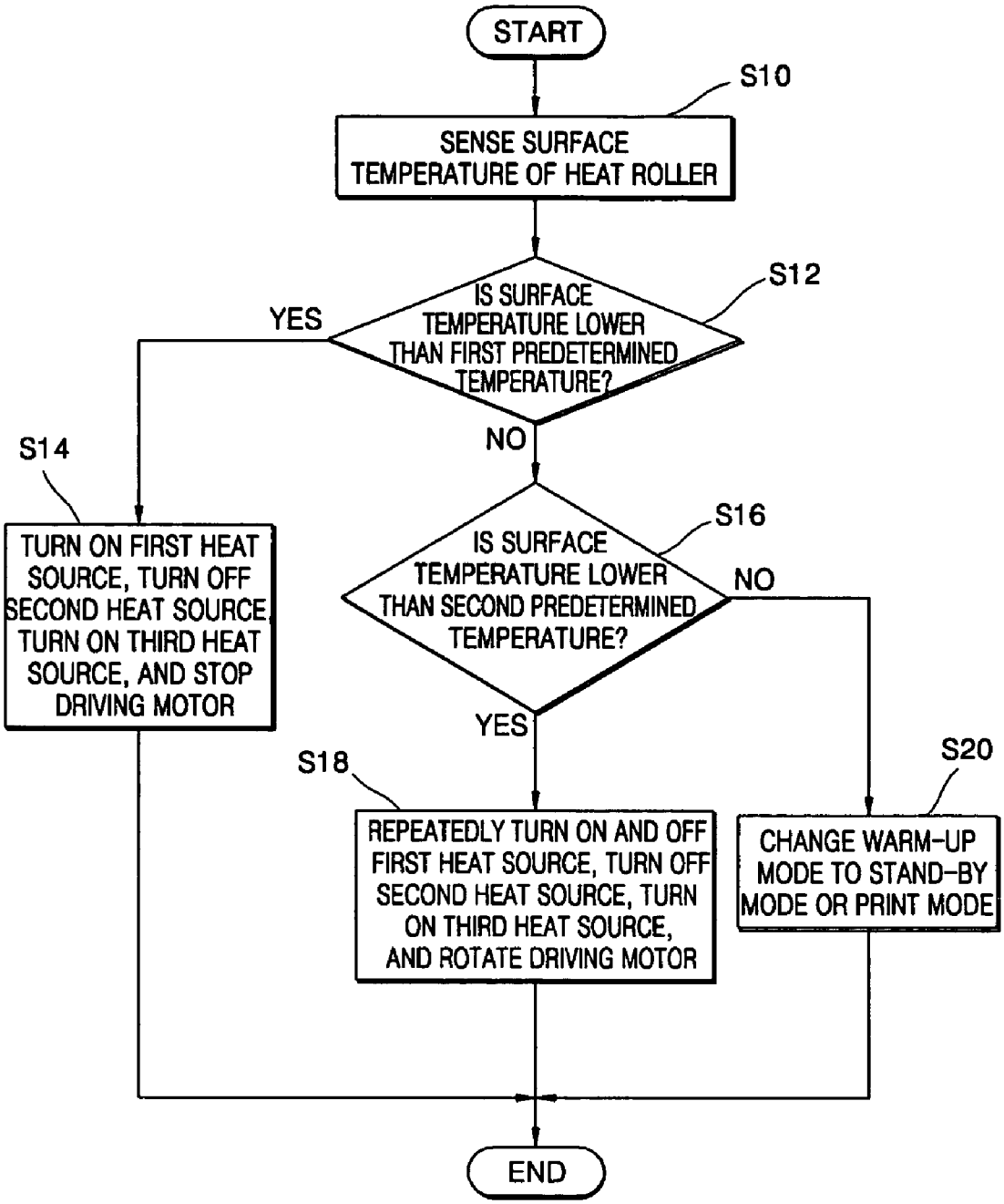
FIG. 4 is a flow chart of a method of controlling a fusing temperature in a warm-up mode according to an exemplary embodiment of the present invention.
Figure 5:
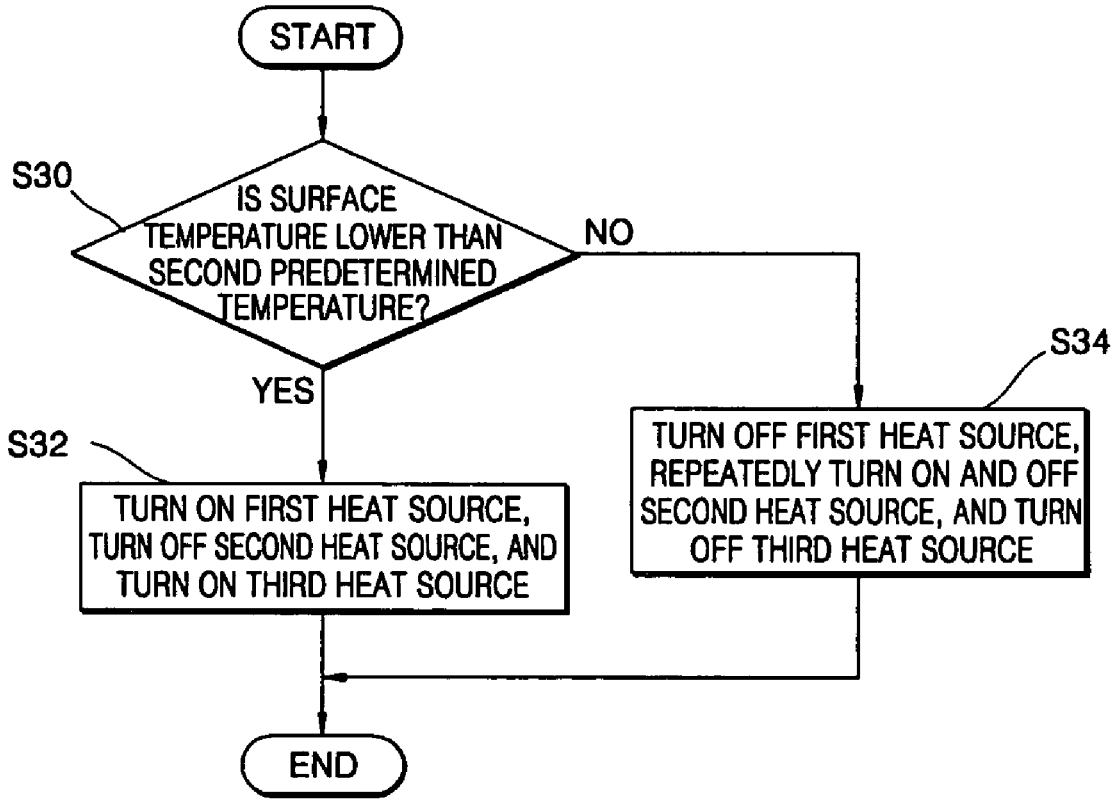
FIG. 5 is a flow chart of a method of controlling a fusing temperature in a stand-by mode or a print mode after the warm-up mode is completed according to an exemplary embodiment of the present invention.
Figure 6A:
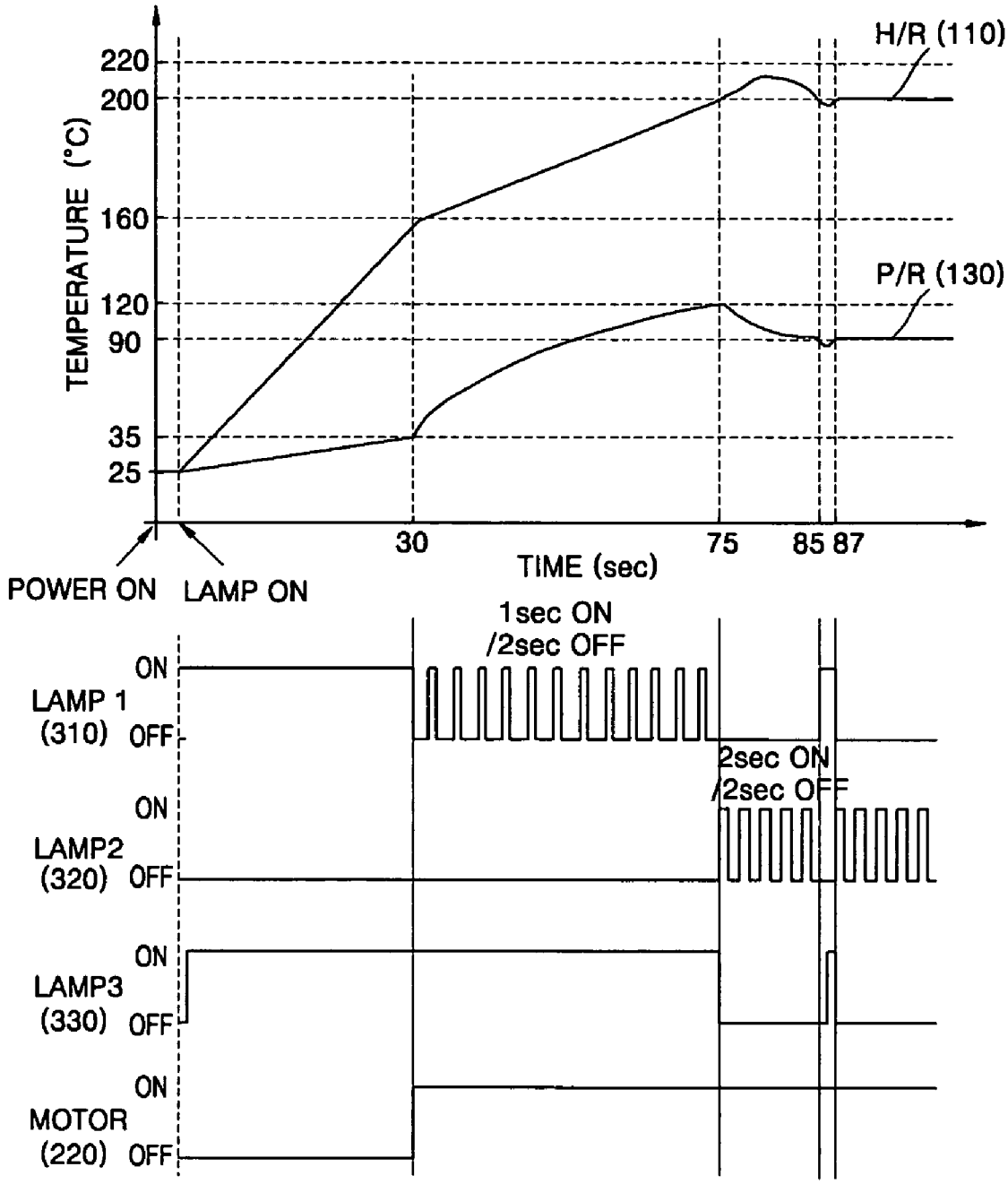
FIG. 6A is a graph of exemplary temperature versus time and waveforms of signals in the warm-up mode and the print mode according to an embodiment of the present invention.
Figure 6B:
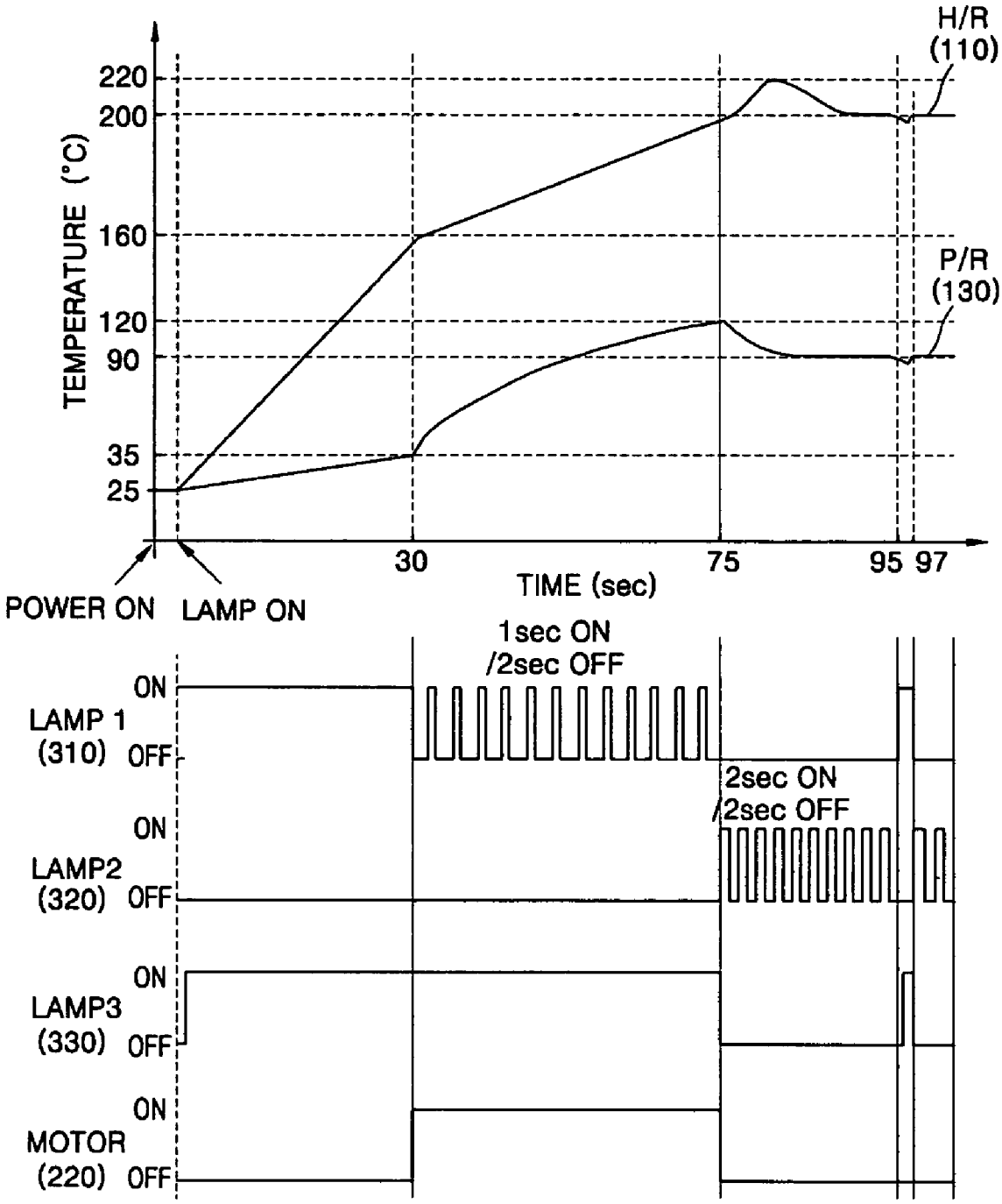
FIG. 6B is a graph of exemplary temperature versus time and waveforms of signals in the warm-up mode and the stand-by mode according to an embodiment of the present invention.

FIG. 4 is a flow chart of a method of controlling a fusing temperature in a warm-up mode according to an exemplary embodiment of the present invention. FIG. 5 is a flow chart of a method of controlling a fusing temperature in a stand-by mode or a print mode after the warm-up mode is completed according to an exemplary embodiment of the present invention. FIG. 6A is a graph of exemplary temperature and waveforms in the warm-up mode and the print mode, and FIG. 6B is a graph of exemplary temperature and waveforms in the warm-up mode and the stand-by mode, according to an embodiment of the present invention. A method of controlling the fusing temperature in the printing apparatus according to an embodiment of the present invention will be explained with reference to the fusing temperature control apparatus shown in FIG. 3 and also with reference to FIGS. 4 through 6B. In the graphs shown in FIGS. 6A and 6B, a horizontal axis represents time in units of seconds, and a vertical axis represents temperature in units of degrees Celsius (° C.).

In operation S10 of FIG. 4, a surface temperature of a heat roller 110 is sensed.

When the printing apparatus is turned on, the printing apparatus enters a warm-up mode. A method of controlling the first through third heat sources 310, 320, and 330, and a driving motor 220, in the warm-up mode to thereby reduce a warm-up time, overshoot, and flicker will be explained first.

In operation S12, it is determined in the warm-up mode whether the surface temperature of the heat roller 110 is lower than a first predetermined temperature. In an exemplary method of FIG. 4, it is preferable that the first predetermined temperature be about 160° C.

If it is determined that the surface temperature is lower than the first predetermined temperature, the process goes to operation S14. In operation S14, the first heat source 310 is turned on, the second heat source 320 is turned off, the third heat source 330 is turned on, and the driving motor 220 stops. In an exemplary method of FIG. 4, it is preferable that the first heat source 310 be comprised of a halogen lamp with a capacity of about 900 watts, the second heat source 320 be comprised of a halogen lamp with a capacity of about 300 watts, and the third heat source 330 be comprised of a halogen lamp with a capacity of about 300 watts. As described above, the second heat source 320 has a lower heat capacity than the first heat source 310.

Accordingly, as shown in FIGS. 6A and 6B, the temperature of the heat roller 110 increases sharply, and the temperature of a pressure roller 130 increases moderately. This is because the halogen lamp with the capacity of about 900 watts is turned on in the heat roller 110, and the halogen lamp with the capacity of about 300 watts is turned on in the pressure roller 130. Further as shown in FIG. 2, the heat roller 110 is generally made of aluminium, but the pressure roller 130 includes an elastic layer made of rubber such that the temperature of the rubber increases slowly. Also, since the driving motor 220 stops, heat supplied to the heat roller 110 is not transferred to the pressure roller 130, and the temperature of the heat roller 110 can increase faster.

If the third heat source 330 is switched on at a predetermined interval, such as at a predetermined interval of about 500 milliseconds, after the first heat source 310 is switched on, flicker can be reduced.

As shown in FIGS. 6A and 6B, about 30 seconds is taken to change the surface temperature of the heat roller 110 from a normal temperature of about 25° C. to about 160° C. after the printing apparatus is turned on.

Next, if it is determined that the surface temperature is not lower than the first predetermined temperature, the process goes to operation S16. In operation S16, it is determined whether the surface temperature is lower than a second predetermined temperature. In an exemplary method of FIG. 4, it is preferable that the second predetermined temperature is about 200° C.

If it is determined that the surface temperature is lower than the second predetermined temperature, the process goes to operation S18. In operation S18, the first heat source 310 is repeatedly turned on for a first predetermined period of time and turned off for a second predetermined period of time. The second heat source 320 is turned off, the third heat source 330 is turned on, and the driving motor 220 rotates. In an exemplary method of FIG. 4, it is preferable that the first predetermined period of time is about 1 second, and the second predetermined period of time is about 2 seconds. That is, the first heat source 310 is turned on for about 1 second and then is turned off for about 2 seconds, repeatedly.

Therefore, as shown in FIGS. 6A and 6B, the temperature of the heat roller 110 increases moderately, and the temperature of the pressure roller 130 increases sharply. This is because the halogen lamp with the capacity of about 900 watts inside the heat roller 110 is turned on for about 1 second and then is turned off for about 2 seconds, and again is turned on for about 1 second and is then turned off for about 2 seconds, repeatedly. Further, since the driving motor 220 rotates, the heat supplied to the heat roller 110 is transferred to the pressure roller 130.

Specifically, the first heat source 310 is controlled using a first signal with a high duty ratio to be turned on when the surface temperature ranges from the normal temperature to the first predetermined temperature, and is controlled using a second signal with a duty ratio lower than that of the first signal to be turned on when the surface temperature ranges from the first predetermined temperature to the second predetermined temperature. In an exemplary method of FIG. 4, it is preferable that the duty ratio of the first signal be about 100% and the duty ratio of the second signal be about 33%.

In this manner, overshoot can be reduced by slowly increasing the surface temperature of the heat roller 110. Further, since the halogen lamp with the capacity of about 900 watts is repeatedly turned off for 2 seconds, power consumption is reduced.

In FIG. 4, if it is determined that the surface temperature is higher than the second predetermined temperature, the process goes to operation S20. In operation S20, the warm-up mode changes to a stand-by mode or a print mode. If the printing apparatus receives a print command during the warm-up mode, the warm-up mode changes to the print mode to perform a printing operation. If the printing apparatus does not receive any print command during the warm-up mode, the warm-up mode changes to the stand-by mode.

Referring to FIG. 5, in operation S30, it is determined whether the surface temperature is lower than the second predetermined temperature in the stand-by mode or the print mode. FIG. 5 is a flow chart of a method of controlling a fusing temperature in a stand-by mode or a print mode after the warm-up mode is completed according to an exemplary embodiment of the present invention.

If it is determined that the surface temperature is lower than the second predetermined temperature, the process goes to operation S32. In operation S32, the first heat source 310 and the third heat source 330 are turned on for a third predetermined period of time, and the second heat source 320 is turned off. In an exemplary method of FIG. 5, it is preferable that the third predetermined period of time is about 2 seconds. Specifically, while the temperature of the heat roller 110 is lower than the second predetermined temperature, the first heat source 310 and the third heat source 330 are turned on. At this time, the third heat source 330 is switched on at a predetermined interval, such as a predetermined interval of 500 milliseconds, after the first heat source 310 is switched on. Thus, flicker can be reduced.

Next, if it is determined that the surface temperature is higher than the second predetermined temperature, the process goes to operation S34. In operation S34, the first heat source 310 and the third heat source 330 are turned off, and the second heat source is repeatedly turned on for a fourth predetermined period of time and turned off for a fifth predetermined period of time. In an exemplary method of FIG. 5, it is preferable that the fourth and fifth predetermined periods of time be about 2 seconds. That is, the second heat source 320 is turned on for about 2 seconds and is turned off for about 2 seconds, repeatedly. That is, the second heat source 320 is controlled using a third signal with a duty ratio of about 50% to be turned on.

As described above, when the surface temperature of the heat roller 110 is higher than about 200° C. in the stand-by mode or the print mode, the second heat source 320 with the lower capacity of about 300 watts is repeatedly turned on and off, thereby reducing power consumption. Further, if the surface temperature is lower than 200° C., the first heat source 310 with the capacity of about 900 watts and the third heat source 330 with the capacity of about 300 watts are turned on, thereby causing the surface temperature of the heat roller 110 to be over 200° C. In this manner, power consumption is reduced and a stable fusing operation can be performed.

Referring to FIGS. 6A and 6B, the graphs of temperature versus time and waveforms of signals in the warm-up mode have the same shape. However, the graphs of temperature versus time and waveforms of signals when the warm-up mode changes to the print mode are different from the graphs of temperature versus time and waveforms of signals when the warm-up mode changes to the stand-by mode. FIG. 6A illustrates the case where the warm-up mode changes to the print mode, and FIG. 6B illustrates the case where the warm-up mode changes to the stand-by mode.

The graphs and waveforms in FIGS. 6A and 6B are different from each other in the length of time taken to turn on the second heat source 320 and the degree of overshoot. Referring to FIG. 6A, it can be seen that the second heat source 320 is repeatedly turned on and off for about 10 seconds, and then the first heat source 310 and the third heat source 330 are turned on for about 2 seconds. In the print mode, since the driving motor 220 rotates, the heat of the heat roller 110 is transferred to the pressure roller 130, such that the surface temperature of the heat roller 110 immediately drops below 200° C. However, referring to FIG. 6B, it is illustrated that the second heat source 320 is repeatedly turned on and off for about 20 seconds, and then the first heat source 310 and the third heat source 330 are turned on for about 2 seconds. In the stand-by mode, since the driving motor 220 stops, the heat of the heat roller 110 is not transferred to the pressure roller 130, such that the surface temperature of the heat roller 110 slowly drops below 200° C.

The exemplary duration wherein only the second heat source 320 is turned on is about 10 seconds in the print mode, and about 20 seconds in the stand-by mode. That is, the durations may vary according to the heat supply to the heat roller 110 and the pressure roller 130, the degree to which a supplied paper absorbs water, and the thickness of the paper. However, it should be taken into account that the time when the first heat source 310 and the third heat source 330 are turned off and only the second heat source 320 is turned on, is longer in the stand-by mode than in the print mode.

The graphs illustrated in FIG. 6A show lower overshoot than the graphs illustrated in FIG. 6B. This is because the driving motor 220 rotates in the print mode such that the heat of the heat roller 110 is transferred to the pressure roller 130.

However, as shown in FIG. 6B, the overshoot occurring in the stand-by mode does not exceed approximately 220° C. According to embodiments of the present invention, since the first heat source 310 and the driving motor 220 are controlled in the warm-up mode, overshoot can be reduced.

As described above, the embodiments of the present invention have the following advantages.

First, the warm-up time can be reduced even in a high rate, fast printer, such as those operating at 50 ppm. For example, about 75 seconds can be taken to change from the normal temperature 25° C. to the fusing temperature 200° C., and a first page out time (FPOT) can be less than 80 seconds.

Second, a stable fusing operation can be achieved even during continuous printing. For example, Gilbert paper of 25% cotton, which was used in a fusing operation test, can have a temperature level of 90% or more even after 500 sheets are printed.

Third, the maximum power can be limited to 1200 watts since the three lamps 310, 320, and 330 are not turned on simultaneously.

Fourth, power consumption can be further reduced since the second heat source 320 with the capacity of about 300 watts inside the heat roller 110 is mainly used for continuous printing, and the first heat source 310 with the capacity of about 900 watts and the third heat source 330 inside the pressure roller 130 are used only when the surface temperature of the heat roller 110 drops below 200° C.

Fifth, flicker can be reduced since the third heat source 330 is switched on at the predetermined interval after the first heat source 310 is switched on.

Sixth, overshoot can be reduced since the first heat source 310 is repeatedly turned on and off, and the driving motor 220 is controlled to rotate in the warm-up mode.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A printing apparatus comprising:

a heat roller for transferring heat to a toner image formed on a printing medium;

a first temperature sensor for sensing a temperature of the heat roller;

a first heat source, which is installed inside the heat roller for heating the heat roller;

a second heat source, which is installed inside the heat roller and has a lower heat capacity than the first heat source for heating the heat roller;

a pressure roller, which is installed to face the heat roller and press the printing medium toward the heat roller; and a control unit for controlling the first heat source and the second heat source based on the temperature sensed by the first temperature sensor, wherein the control unit is configured to turn off the first heat source and to turn on the second heat source upon determination that the temperature sensed by the first temperature sensor is higher than a first predetermined temperature.

2. The printing apparatus of claim 1, further comprising:

a third heat source, which is installed inside the pressure roller for heating the pressure roller, wherein the control unit further controls the third heat source.

3. The printing apparatus of claim 2, further comprising:

a second temperature sensor for sensing a temperature of the pressure roller, wherein the control unit controls the third heat source based on the temperature sensed by the second temperature sensor.

4. The printing apparatus of claim 2, wherein the control unit is further configured to:

turn on the third heat source at a predetermined short interval after the control unit turns on the first heat source.

5. The printing apparatus of claim 4, wherein the predetermined short interval is less than about 500 ms.

6. The printing apparatus of claim 2, wherein the control unit is further configured to turn on the first heat source and turn off the second heat source in a warm-up mode.

7. The printing apparatus of claim 6, wherein the control unit is further configured to:

control the first, second, and third heat sources in at least two steps, such that the temperature of the heat roller can reach a second predetermined temperature which is higher than a normal temperature in a first step, and the temperature of the heat roller can reach the first predetermined temperature which is higher than the second predetermined temperature and is high enough to fuse and fix toner in a second step.

8. The printing apparatus of claim 7, wherein the control unit is further configured to:

turn on the first heat source using a first signal with a high duty ratio if the temperature of the heat roller ranges from the normal temperature to the second predetermined temperature; and turn on the first heat source using a second signal with a duty ratio lower than that of the first signal if the temperature of the heat roller ranges from the second predetermined temperature to the first predetermined temperature.

9. The printing apparatus of claim 8, wherein the duty ratio of the first signal is about 100%, and the duty ratio of the second signal is about 33%.

10. The printing apparatus of claim 7, wherein the control unit is further configured to:

turn on the second heat source in a print mode in which the printing apparatus performs a printing operation; and turn on the second heat source in a stand-by mode in which a print signal is waited for.

11. The printing apparatus of claim 10, wherein the control unit is further configured to:

control the first, second and third heat sources in the print mode and the stand-by mode so that the first through third heat sources can maintain the first predetermined temperature.

12. The printing apparatus of claim 11, wherein the control unit is further configured to:

turn on at least one of the first heat source and the third heat source in the print mode and the stand-by mode while the temperature of the heat roller is lower than the first predetermined temperature.

13. The printing apparatus of claim 12, wherein the control unit is further configured to:

turn on the third heat source at a predetermined short interval after the control unit turns on the first heat source.

14. The printing apparatus of claim 13, wherein the predetermined short interval is less than about 500 ms.

15. The printing apparatus of claim 10, wherein the control unit is further configured to:

control the second heat source using a third signal with a duty ratio of about 50% to turn on the second heat source.

16. The printing apparatus of claim 1, further comprising a driving motor for driving the heat roller and the pressure roller.

17. The printing apparatus of claim 16, wherein the driving motor is configured to stop in a warm-up mode until the temperature of the heat roller reaches a second predetermined temperature that is higher than a normal temperature.

18. The printing apparatus of claim 16, wherein the driving motor is configured to stop in a stand-by mode in which a print signal is waited for.

19. A fusing apparatus comprising:

a heat roller for transferring heat to a toner image formed on a printing medium;

a first heat source, which is installed inside the heat roller for heating the heat roller;

a second heat source, which is installed inside the heat roller and has a lower heat capacity than the first heat source for heating the heat roller; and a pressure roller, which is installed to face the heat roller and press the printing medium toward the heat roller, wherein the first heat source is turned off and the second heat source is turned on upon determination that the temperature of the heat roller is higher than a predetermined temperature.

20. The fusing apparatus of claim 19, further comprising a third heat source, which is installed inside the pressure roller for heating the pressure roller.

21. A method of controlling a fusing temperature in a printing apparatus, which includes a heat roller for transferring heat to a toner image formed on a printing medium and a pressure roller facing the heat roller for pressing the printing medium toward the heat roller to fuse the toner image to the printing medium, the method comprising the steps of:

sensing a temperature of the heat roller;

determining whether the temperature of the heat roller is a first predetermined temperature which is higher than a normal temperature, or is a second predetermined temperature which is higher than the first predetermined temperature and is high enough to fuse and fix toner; and controlling a first heat source which is installed inside the heat roller, and a second heat source which is installed inside the heat roller and has a lower heat capacity than the first heat source, according to the determined temperature of the heat roller, wherein the first heat source is turned off and the second heat source is turned on upon determination that the temperature sensed by the first temperature sensor is higher than the second predetermined temperature.

22. The method of claim 21, further comprising the step of:

turning on the first heat source and turning off the second heat source in a warm-up mode.

23. The method of claim 21, further comprising the step of:

controlling the first heat source and the second heat source such that the first heat source and the second heat source are not turned on simultaneously in a print mode in which the printing apparatus performs a printing operation or in a stand-by mode in which a print signal is waited for.

24. The method of claim 21, further comprising the steps of:

controlling the first heat source using a signal with a higher duty ratio if the temperature of the heat roller ranges from the normal temperature to the first predetermined temperature; and controlling the first heat source using a signal with a lower duty ratio if the temperature of the heat roller ranges from the first predetermined temperature to the second predetermined temperature.

25. The method of claim 21, further comprising the step of:

controlling a third heat source which is installed inside the pressure roller to heat the pressure roller, wherein the third heat source is turned on in a warm-up mode.

26. The method of claim 25, further comprising the step of:

turning on the first heat source and the third heat source in a print mode and a stand-by mode while the temperature of the heat roller is lower than the second predetermined temperature, wherein the third heat source is turned on at a predetermined short interval after the first heat source is turned on.

27. The method of claim 21, further comprising the step of:

controlling a driving motor which drives the heat roller and the pressure roller to stop until the temperature of the heat roller reaches the first predetermined temperature which is higher than the normal temperature or when in a stand-by mode in which a print signal is waited for.

* * * * *